US010693251B2

(12) United States Patent
Ross et al.

(10) Patent No.: US 10,693,251 B2
(45) Date of Patent: Jun. 23, 2020

(54) ANNULAR WET CONNECTOR

(71) Applicant: Baker Hughes, a GE Company, LLC, Houston, TX (US)

(72) Inventors: Colby W. Ross, Hockley, TX (US); Charles Alexander McClean, Spring, TX (US); Patrick Ryan Markwardt, Brenham, TX (US); Timothy W. Sampson, Tomball, TX (US)

(73) Assignee: Baker Hughes, a GE Company, LLC, Houston, TX (US)

( * ) Notice: Subject to any disclaimer, the term of this patent is extended or adjusted under 35 U.S.C. 154(b) by 100 days.

(21) Appl. No.: 15/813,382

(22) Filed: Nov. 15, 2017

(65) Prior Publication Data

US 2019/0148861 A1 May 16, 2019

(51) Int. Cl.
*E21B 17/02* (2006.01)
*H01R 13/00* (2006.01)
(Continued)

(52) U.S. Cl.
CPC ..... *H01R 13/005* (2013.01); *E21B 17/003* (2013.01); *E21B 17/028* (2013.01); *E21B 43/116* (2013.01); *H01R 25/162* (2013.01); *H01R 13/523* (2013.01); *H01R 13/6277* (2013.01); *H01R 24/38* (2013.01); *H01R 2107/00* (2013.01)

(58) Field of Classification Search
CPC ..... H01R 13/005; H01R 13/6277; H01R 25/162; E21B 17/028; E21B 17/003
See application file for complete search history.

(56) References Cited

U.S. PATENT DOCUMENTS 5,058,683 A 10/1991 Godfrey et al.
5,810,088 A 9/1998 Lamirand et al.
(Continued)

FOREIGN PATENT DOCUMENTS

EP 3006801 A2 9/2015

OTHER PUBLICATIONS

International Search Report and Written Opinion for PCT/US2018/059034 filed Nov. 2, 2018.
(Continued)

*Primary Examiner* — Giovanna C Wright
*Assistant Examiner* — Brandon M Duck
(74) *Attorney, Agent, or Firm* — Hogan Lovells US LLP

(57) ABSTRACT

A connector assembly attaches downhole tools to one another to form a tool string. The connector assembly includes male and female subs, each with latch ends that selectively latch to one another. Ends of the subs distal from their latch ends are configured for attachment to the downhole tools. A plug assembly is in one of the subs and a socket assembly is disposed in the other sub; the plug and socket assemblies mate with one another when the subs attach. Mating the plug and socket assemblies forms a signal communication path through the connector assembly so that adjacent tools are in signal communication. The plug and socket assemblies and male and female subs are annular and circumscribe a bore that extends axially through the connector assembly. Downhole tools that attach to opposing ends of the connector assembly are in communication through the bore in the connector assembly.

16 Claims, 8 Drawing Sheets

(51) Int. Cl.

| | |
|---|---|
| ***H01R 13/627*** | (2006.01) |
| ***H01R 25/16*** | (2006.01) |
| ***E21B 17/00*** | (2006.01) |
| ***E21B 43/116*** | (2006.01) |
| *H01R 13/523* | (2006.01) |
| *H01R 107/00* | (2006.01) |
| *H01R 24/38* | (2011.01) |

(56) References Cited

U.S. PATENT DOCUMENTS

| | | | | |
|---|---|---|---|---|
| 5,820,416 | A | 10/1998 | Carmichael | |
| 6,981,546 | B2 | 1/2006 | Hall et al. | |
| 7,117,944 | B2 | 10/2006 | Boyadjieff | |
| 7,798,213 | B2 | 9/2010 | Harvey et al. | |
| 8,462,013 | B2 | 6/2013 | Hawthorn et al. | |
| 8,474,879 | B2 | 7/2013 | Herrera | |
| 8,833,472 | B2 | 9/2014 | Hay | |
| 9,447,644 | B2 | 9/2016 | Millet et al. | |
| 9,540,895 | B2 | 1/2017 | Mackenzie et al. | |
| 9,556,686 | B1 * | 1/2017 | Krumpe | H01R 13/523 |
| 9,574,409 | B2 | 2/2017 | Briscoe et al. | |
| 9,650,870 | B2 | 5/2017 | Jenkins et al. | |
| 2006/0151179 | A1 * | 7/2006 | Boyadjieff | E21B 17/003 166/380 |
| 2012/0012301 | A1 | 1/2012 | Hughes et al. | |
| 2012/0298361 | A1 * | 11/2012 | Sampson | E21B 23/01 166/297 |
| 2013/0106615 | A1 | 5/2013 | Prammer | |
| 2014/0041945 | A1 | 2/2014 | Guelaz et al. | |
| 2014/0144614 | A1 | 5/2014 | Buda et al. | |
| 2015/0047854 | A1 | 2/2015 | Hradecky et al. | |
| 2015/0308249 | A1 | 10/2015 | Delchambre et al. | |
| 2016/0049718 | A1 | 2/2016 | Mueller et al. | |
| 2017/0201039 | A1 * | 7/2017 | Jenkin | H01R 13/523 |
| 2017/0204680 | A1 | 7/2017 | Leismer et al. | |

OTHER PUBLICATIONS

National Oilwell Varco, Intelliserv Product Catalog, Dec. 31, 2013.

* cited by examiner

FIG.3B
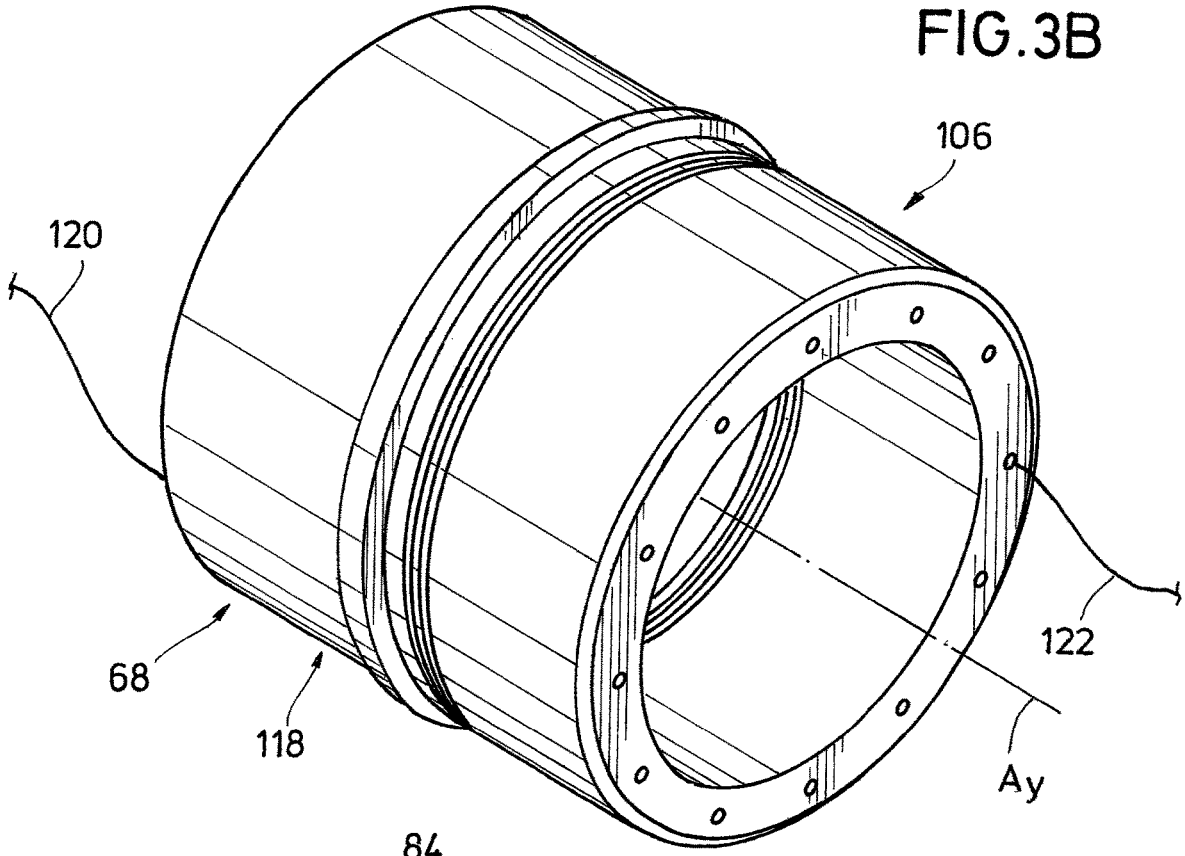
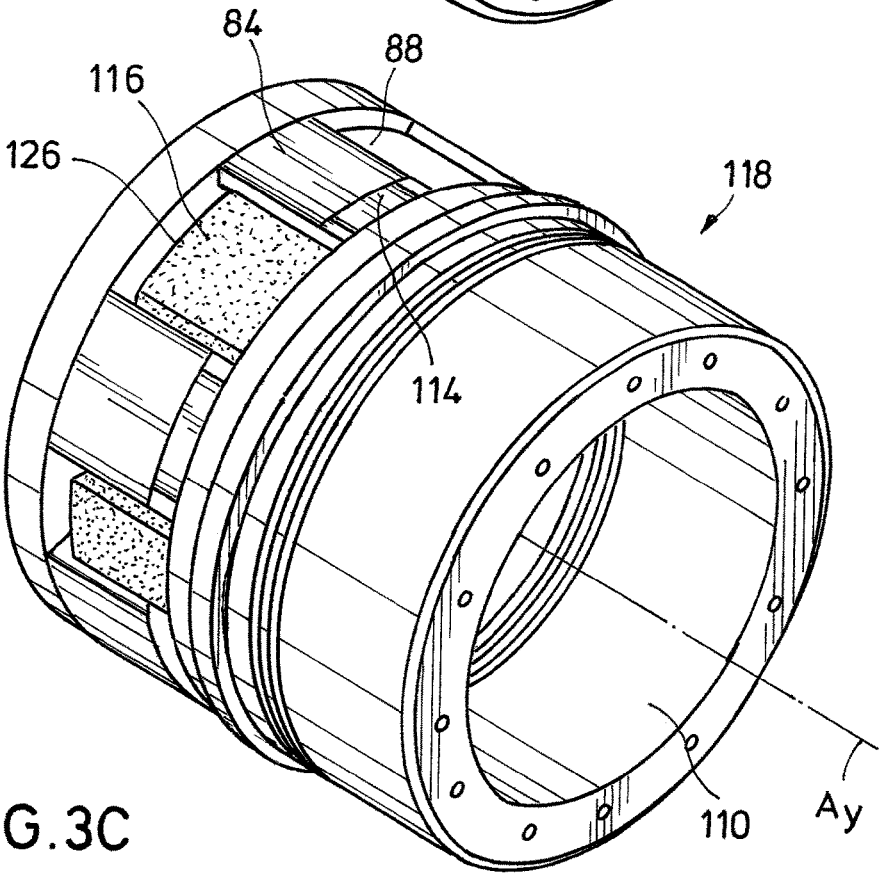
FIG.3C

116
L1
W
t1
142
t2
140
130
136
114
138
L3
t3
t4
L2
84
128
132
t5
134

W1
W3
W2
188

ANNULAR WET CONNECTOR

BACKGROUND OF THE INVENTION

1. Field of Invention

The present disclosure relates to an electrical wet connector for use in downhole tools. More specifically, the present disclosure relates to an annular electrical wet connector that circumscribes a path for selective fluid flow and across which several avenues for signal communication are established.

2. Description of Prior Art

Operations that are typically performed in a subterranean wellbore include completion, servicing, remediation, testing, exploration, and production. A number of different tools are utilized to conduct these tasks, such as perforation guns, tools for injecting fluids downhole, fishing tools, imaging tools, and submersible pumps. Often the tools are mechanically connected to other tools, and deployed in the wellbore as part of a downhole string. The other tools are sometimes of the same type, such as when a number of perforating guns are connected to form a perforating string. In other situations, different types of tools that perform different functions are connected together in the string, such as an imaging tool (e.g. acoustic, electromagnetic, or nuclear) coupled with a testing tool.

Space limitations at the wellhead often dictate that the downhole strings be formed by successively landing individual tools atop one another, which is often accomplished with the aid of a lubricator mounted on a wellhead assembly. Frequently the tools in the string are in electrical communication with one another via electrical connections that are between adjacent tools. The electrical connections are sometimes electrically conducting sections on adjacent tools configured to contact each other when tools connect and form a closed circuit when the string is assembled. Wet connects are also occasionally employed for the electrical communication, and which usually include terminals on adjacent tools that are automatically connected as the tools are drawn together.

SUMMARY OF THE INVENTION

Disclosed herein is an example of a connector assembly for use in a downhole tool string and which includes an axis, an annular male sub having an upstream end profiled for attachment to a first downhole tool, a downstream end, and a protrusion on an outer surface, an annular female sub having an upstream end adapted for insertion of the downstream end of the male sub, a downstream end profiled for attachment to a second downhole tool, and a sidewall having an aperture that receives the protrusion when the male sub is inserted into the upstream end. Also included is a socket assembly in the male sub that includes, receptacles arranged along a path that circumscribes the axis, and signal leads that are connected to each of the receptacles. A plug assembly is in the female sub that includes conductor elements that each engage a one of the receptacles when the first and second subs are latched to one another, insulating tabs disposed between adjacent ones of the conductor elements that occupy spaces between adjacent receptacles when the conductor elements engage the receptacles and define electrically insulating barriers in the spaces, and signal leads that are connected to each of the conductor elements, and that are in respective communication with the signal leads connected to the receptacles. In an example, the socket and plug assemblies form an electrical wet connect when the conductor elements engage the receptacles. In an example, the signal leads are connected to the receptacles and are in signal communication with the first downhole tool, and wherein the signal leads connected to the conductor elements are in signal communication with the second downhole tool, and wherein the first and second downhole tools are in signal communication via the electrical wet connection. Optionally, the signal leads on the socket assembly are combined into a socket assembly electrical bus, and wherein the signal leads on the plug assembly are combined into a plug assembly electrical bus. In one alternative, the receptacles have inner and outer radial surfaces that are curved along a path that circumscribes the axis. Examples exist where the receptacles each have a channel that extends between lateral surfaces of the receptacles and along a path that circumscribes the axis, and wherein pins on the ends of the conductor elements axially insert into the receptacles. In an embodiment, the conductor elements have ends that anchor into an insulator ring that circumscribes the axis, and wherein the conductor elements project axially away from insulator ring. In one example, the socket assembly includes an annular boot having inner and outer sidewalls that extend longitudinally along the axis and that are disposed radially away from one another to form an annulus, and wherein the receptacles are in the annulus. Ends of the receptacles opposite from their engagement with the conductor elements are optionally set in a mounting ring in the annulus. The signal leads in the plug assembly can be electrically isolated from one another, and the signal leads in the socket assembly can be electrically isolated from one another.

Also disclosed herein is a connector assembly for use in a downhole tool string and which includes an axis, first and second subs that selectively latch to one another on proximate ends, and each have distal ends that are profiled for respective attachment to first and second downhole tools. A socket assembly is included in the first sub which is made up of receptacles arranged along a path that circumscribes the axis, and signal leads that are connected to each of the receptacles. Further included is a plug assembly in the second sub having conductor elements that each engage a one of the receptacles when the first and second subs are latched to one another, insulating tabs disposed between adjacent ones of the conductor elements that occupy spaces between adjacent receptacles when the conductor elements engage the receptacles and define electrically insulating barriers in the spaces, and signal leads that are connected to each of the conductor elements, and that are in respective communication with the signal leads connected to the receptacles. Channels may optionally be formed in ends of the receptacles facing the conductor elements and that are at substantially the same radial location as ends of the conductor elements facing the receptacles, so that when the socket and plug assemblies are urged together, the ends of the conductor elements insert into the channels. In an example, the socket assembly includes a boot with an annular space in which the receptacles are disposed, and wherein the conductor elements and insulating tabs insert into the annular space when the conductor elements engage the receptacles. Optionally, an axial bore is included that is circumscribed by the socket and plug assemblies, and wherein the first and second downhole tools are in communication with one another through the axial bore.

An example of a downhole string is disclosed herein and which includes a first downhole tool, a second downhole tool, and a connector assembly. The connector assembly includes first and second subs latched to one another on proximate ends, and attached to the first and second downhole tools on respective distal ends, receptacles in the first sub that are arranged along a path that circumscribes the axis, conductor elements in the second sub that each engage a one of the receptacles when the first and second subs are latched to one another, insulating tabs disposed between adjacent ones of the conductor elements that occupy spaces between adjacent receptacles when the conductor elements engage the receptacles and define electrically insulating barriers in the spaces, and signal leads that are connected to each of the conductor elements, and that are in respective communication with signal leads connected to the receptacles. In an embodiment, the first and second downhole tools are perforating guns. A controller is optionally included that is in electrical communication with the downhole tools via connections between the receptacles and conductor elements.

BRIEF DESCRIPTION OF DRAWINGS

Some of the features and benefits of the present invention having been stated, others will become apparent as the description proceeds when taken in conjunction with the accompanying drawings, in which:

FIG. 3B is a perspective view of an example of an electrical wet connect for use in the connector assembly of FIG. 1.

FIG. 3C is a perspective partial cut away view of the electrical wet connect of FIG. 3B.

Figure 1:
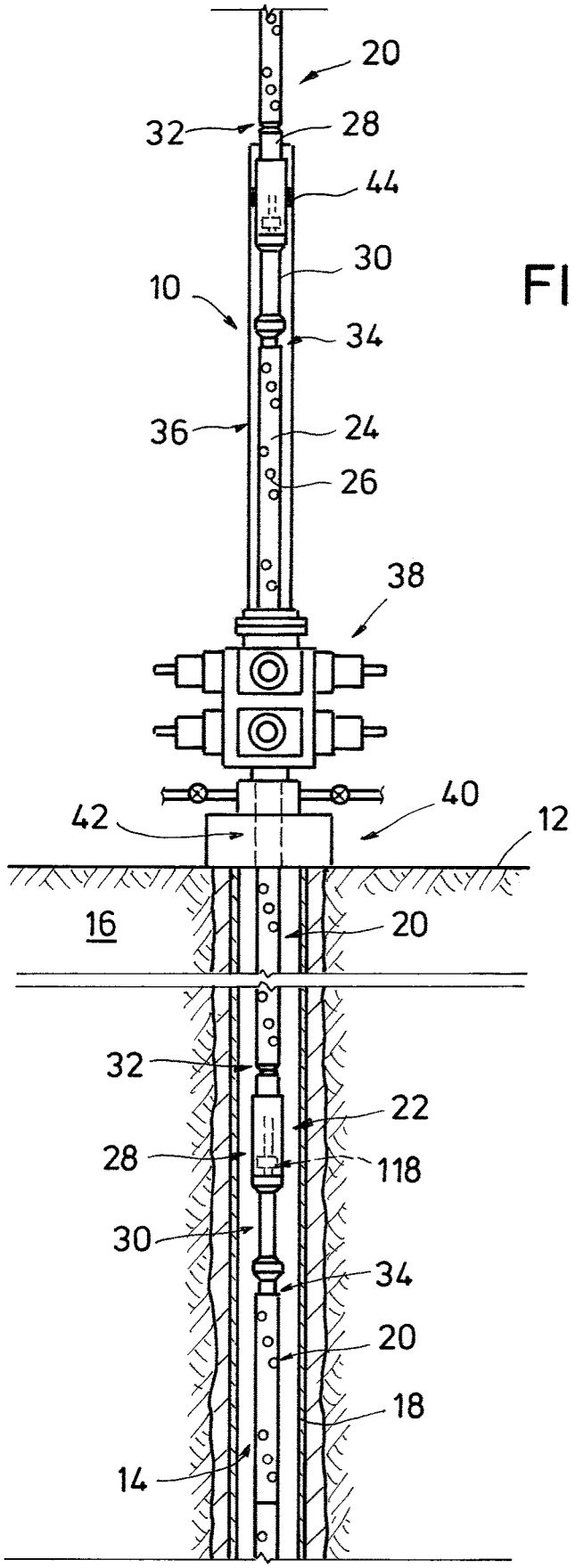
FIG. 1 is a side partial sectional view of an example of a tool string being assembled.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

One example of forming a downhole string 10 is shown in a side partial sectional view in FIG. 1. Here, the string 10 is being assembled on surface 12 prior to being inserted into a wellbore 14. In the illustrated example, wellbore 14 intersects a subterranean formation 16 and is lined with casing 18. As shown, a number of downhole tools 20 are being connected to one another with connector assemblies 22 that provide connection between adjacent downhole tools 20. As will be described in more detail below, the connector assemblies 22 also provide electrical and fluid communication to adjacent the tools 20. In the example of FIG. 1, the downhole tools 20 are depicted as perforating guns and which are made up of a generally cylindrically shaped gun body 24, and shaped charges 26 disposed in the gun body 24.

In the example process of forming the string 10, a male sub 28 is shown connected to a lower or downstream end of one of the downhole tools 20. The male sub 28 and tool 20 are shown being lowered towards an upstream end of a female sub 30. The male and female subs 28, 30 engage one another when abutted to form the connector assembly 22, that in turn couples downhole tools 20 that are attached to opposite ends of the male and female subs 28, 30. Threaded connections 32, 34 illustrate one manner of connecting the male and female subs 28, 30 to the respective downhole tools 20. In an alternate example, downhole tools 20 engage with male and female subs 28, 30 by latching assemblies. In the illustrated example of assembling the downhole string 10, engagement between the male and female subs 28, 30 takes place in a lubricator 36. The lubricator 36 is schematically illustrated mounted atop a blowout preventer (BOP) 38 that in turn sets on a wellhead assembly 40. The inside of lubricator 36 is in selective communication with a main bore 42 shown extending axially within wellhead assembly 40. A packer 44 or other seal is provided within lubricator 36, and which provides a pressure barrier between atmosphere and wellbore pressures so that string 10 can be formed while the well 14 is "live" and pressurized, and without the need to shut down or otherwise eliminate pressure within well 14.

Figure 2:
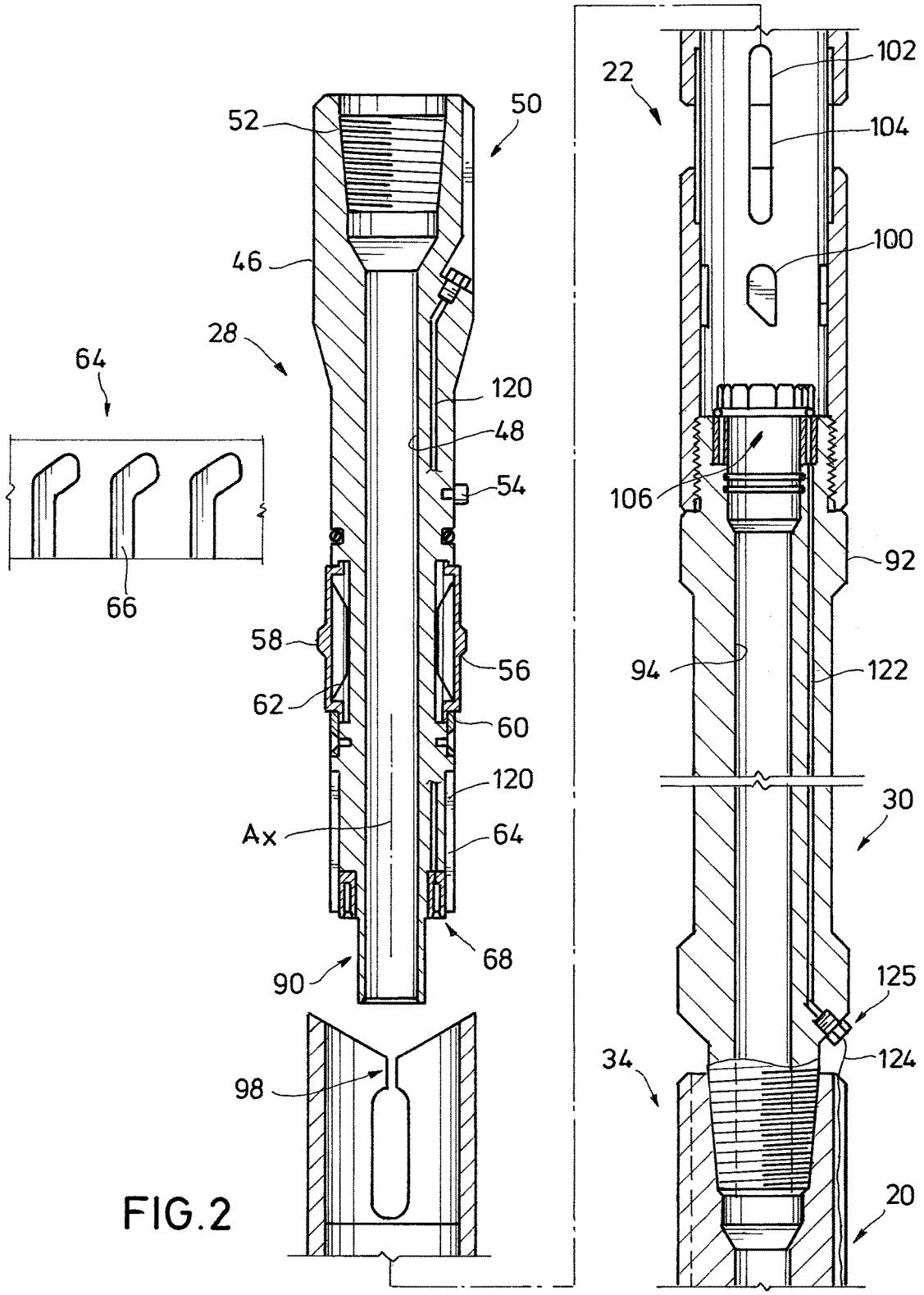
FIG. 2 is a side sectional exploded view of an example of a connector assembly in the tool string of FIG. 1.

Shown in a side sectional exploded view in FIG. 2 is one example of the connector assembly 22 with the male and female subs 28, 30 set axially apart from each other. The positions of the male and female subs 28, 30 exemplifies representative locations prior to the subs 28, 30 being coupled, or just after decoupling. In this embodiment, male sub 28 is illustrated as an annular member having a main body 46 with sidewalls and a bore 48 that extends along an axis $A_X$ of the connector assembly 22. Included on the male sub 28 is a box end 50 shown on its upstream end and where threads 52 are optionally formed for attachment to one of the downhole tools 20 (FIG. 1). In an alternative, an alignment pin 54 projects radially outward from a sidewall of the body 46 of the male sub 28. As will be described in more detail below, alignment pin 54 provides one manner of azimuthally orienting the male sub 28 when being coupled to the female sub 30. Optionally included on radial outer surfaces of the male sub 28 are keys 56, which are elongate members extending along the axis $A_X$, mid portions of the keys 56 include protrusions 58 that project radially outward from the keys 56. The keys 56 are illustrated positioned over cavities 60 formed in the sidewall of body 46. Springs 62 in the cavities 60 provide a radially outward biasing force. In an alternative, a J-hook profile 64 is formed on an outer surface of male sub 28 and which as shown in the insert includes a number of J-shaped recesses 66 that extend axially along the male sub 28. The J-hook profile like the alignment pin 54, provides one precise way of orienting the sub 28 when landing within the female sub 30.

Figure 3A:
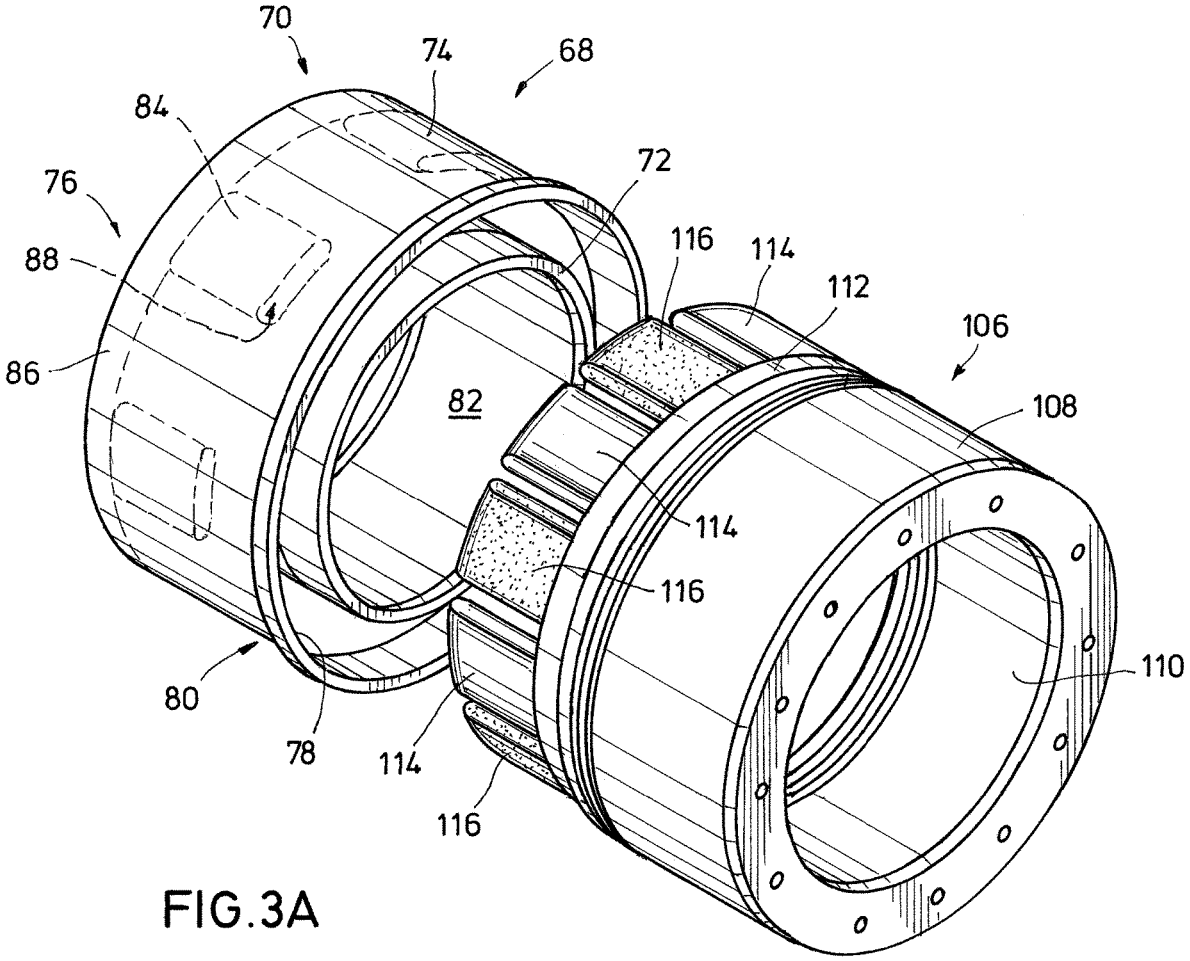
FIG. 3A is a perspective view of examples of socket and plug assemblies in the connector assembly of FIG. 2.

A socket assembly 68 is provided in the example of FIG. 2 that is adjacent the J-hook profile 64 and circumscribes the axis $A_X$. Socket assembly 68 is part of an assembly for providing a continuous signal communication path along the tool string 10. A perspective view of an example of the socket assembly 68 is shown in FIG. 3A. Here, an annular boot 70 provides an outer covering for the socket assembly 68, and which includes an inner sidewall 72 that extends a distance along the axis $A_X$, and an outer sidewall 74 that is positioned generally parallel with inner sidewall 72. Inner and outer sidewalls 72, 74 converge along an upstream end 76; opposite upstream end 76 the sidewalls 72, 74 maintain their radial distance from one. In the example of FIG. 3A, an annulus 78 is defined between the sidewalls 72, 76 that projects from upstream end 76 to the downstream end 80. A bore 82 extends axially within boot 70 and which generally circumscribes axis $A_X$. Disposed within the annulus 78 are a number of receptacles 84 that have upstream ends set in a mounting ring 86, which is proximate upstream end 76 and in the lower end of the annular space 78. Receptacles 84 are spaced angularly apart and along the circumference of mounting ring 86. Channels 88 are formed laterally through the receptacles 84, and on the ends distal from where the receptacles 84 are set in mounting ring 86. Portions of the receptacles 84 having channels 88 have a generally elongate U-shaped cross-section when viewed along a path circumscribing axis $A_X$.

Referring back to FIG. 2, the example of the female sub 30 is shown having an annular connector sleeve 90 and a main body 92 coaxially coupled to one another. An end of connector sleeve 90 distal from the main body 92 is profiled to terminate at a plane oriented oblique with axis $A_X$, thereby approximating a scoop-like configuration. Axial bore 94 extends through the connector sleeve 90 and main body 92. A slot 98 is shown formed through a sidewall of the connector sleeve 90 at a location where the upstream end of the connector sleeve 90 is most proximate to the main body 92. As male sub 28 inserts into female sub 30 alignment pin 54 lands on upstream end of connector sleeve 90 and slides along the upstream end and towards slot 98. When sliding on the upstream end, the alignment pin 54 follows a generally helical path which rotates the male sub 28 until pin 54 enters slot 98. Slot 98 is strategically located to orient male sub 28 for assembly of the connector assembly 22. Lugs 100 are formed on the inner surface of the connector sleeve 90, and which insert into one of the recesses 66 on J-hook profile 64 as male sub 28 inserts into female sub 30. The profiles of the recesses 66 rotate the male sub 28 into a designated azimuthal orientation of the respective male and female subs 28, 30. Latching together of the male and female subs 28, 30 occurs when the keys 56 come into alignment with channels 102 shown extending axially within the inner surface of connector sleeve 90. Springs 62 urge keys 56 radially outward so that protrusions 56 project through apertures 104 that intersect sidewall of connector sub 90. The combination of the keys 56 in channels 102, and lugs 100 in the profiled recesses 66, latches together the male and female subs 28, 30. In an example, subs 28, 30 are uncoupled by pressing rams (not shown) in BOP 38 (FIG. 1) radially inward against keys 56 while applying an axial upward force onto the male sub 28.

Shown in FIG. 2 and in FIG. 3A are embodiments of a plug assembly 106 which is formed to strategically engage the receptacle assembly 68 as the male and female subs 28, 30 are brought together. The plug assembly 106 includes an annular body 108 that is intersected by an axial bore 110. Bore 110 is intersected by bore 94 so that communication extends through the connector assembly 22 via bore 48, bore 110 and bore 94. On an upstream end of body 108 is an insulator ring 112 that also circumscribes bore 110 and from which conductor elements 114 and insulating tabs 116 extend axially away from body 108. The elements and tabs 114, 116 are illustrated as generally planar elements and have inner and outer radial surfaces that are curved at a radii similar to that of the inner and outer surfaces of body 108. In an example, conductor elements 114 are include electrically conducting material, and the insulating tabs 116 include dielectric or other insulating material and designed to insulate in the between the adjacent ones of the receptacles 84. Illustrated in a perspective view in FIG. 3B, is an example of an electrical wet connect 118 formed by axially engaging socket assembly 68 and plug assembly 106 so that conductor elements 114 are in electrical contact with receptacles 84. Further in the illustrated example, forming electrical wet connect 118 places socket and plug assemblies 68, 106 in electrical communication.

Still referring to the example of FIG. 3B, an electrical bus 120 is illustrated attached to an end of the socket assembly 68 and which carries lines that are in communication with each of the receptacles 84 (FIG. 3A) that are within the socket assembly 68. Similarly, an electrical bus 122 is shown connected to an end of the plug assembly 106 and which includes lines in communication with each of the conductor elements 114 within the plug assembly 106. Referring back to the example of FIG. 2, electrical bus 122 connects with electrical bus 124 via connector 125, electrical bus 124 is shown mounted on downhole tool 20 downstream of connector assembly 22. Thus in the illustrated embodiment electrical communication takes place along the entire tool string 10 by an electrical wet connect 118 provided in each of the connector assemblies 22. Shown in perspective view in FIG. 3C is a partial cutaway view of the example of the electrical wet connect 118. In this example, spaces 126 are shown between adjacent ones of the receptacles 84. The spaces 126 have lengths that extend along an axis $A_Y$ of the wet connect 118, and widths that extend along a path that circumscribes bore 110. The insulating tabs 116 are strategically formed to fill occupy the spaces 126 so that adjacent ones of the receptacles 84 are isolated electrically from one another. The strategic forming of the insulating tabs 116 is such that any fluid that may be in one of the spaces 126 is urged away or isolated thereby preventing electrical communication between adjacent receptacles 84 or conductor elements 114.

Figure 4A:
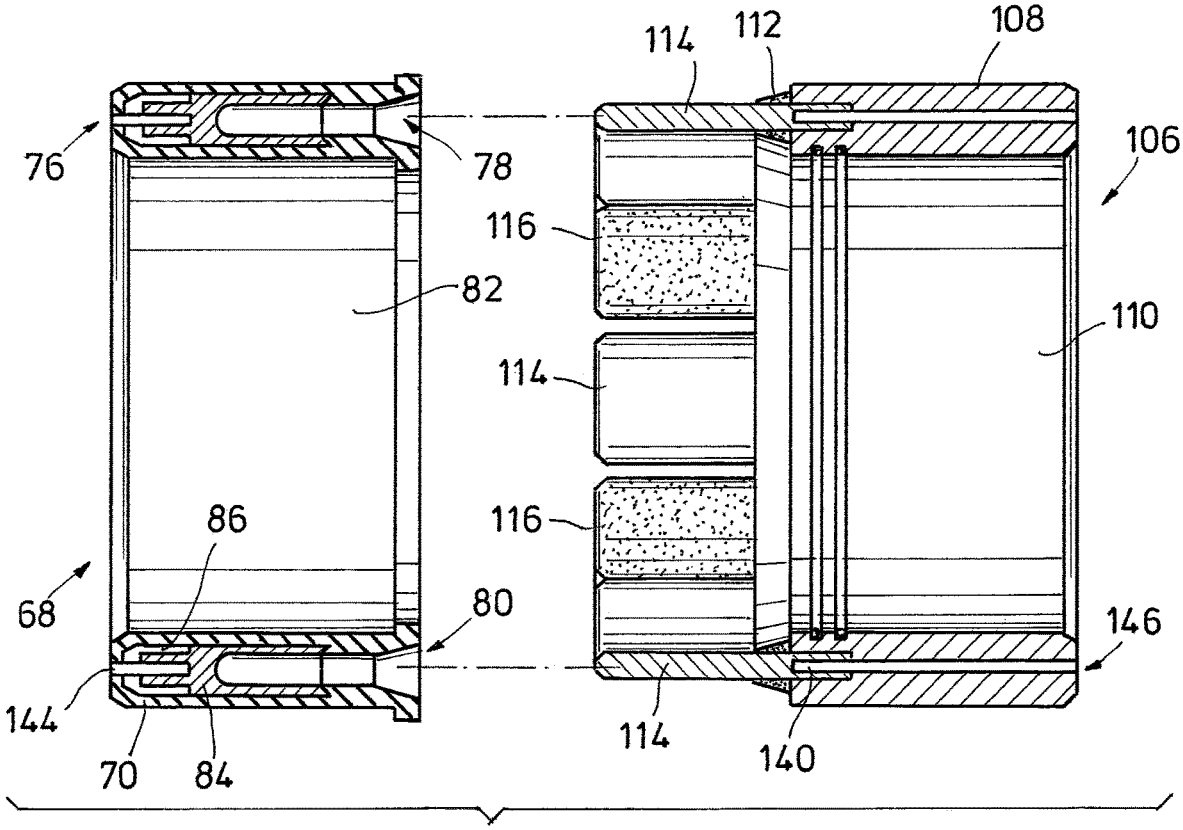
FIG. 4A is a side sectional view of examples of the socket and plug assemblies of FIG. 3A.
Figure 4C:
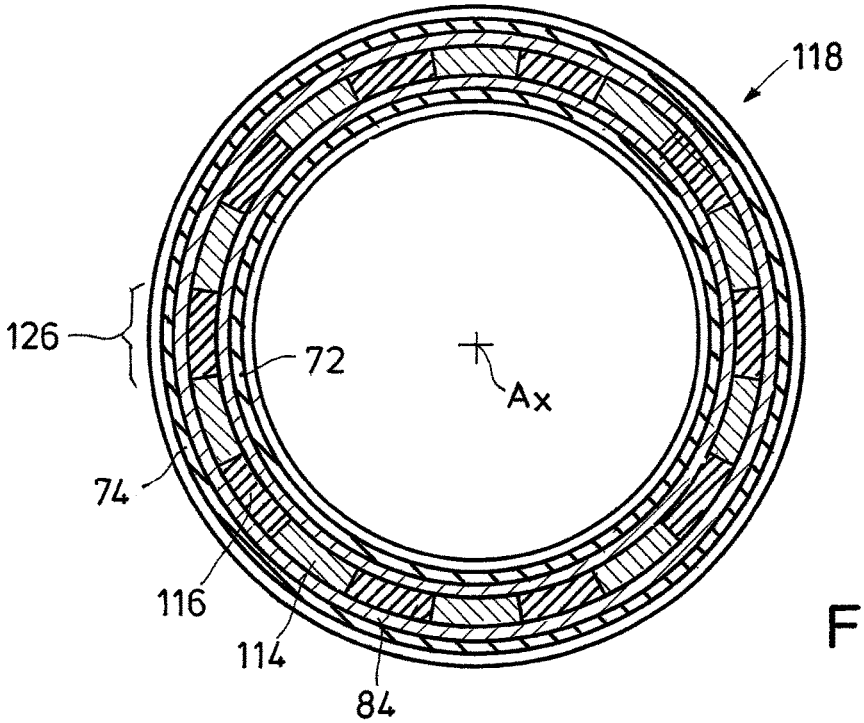
FIG. 4C is an axial sectional view of an example of the electrical wet connect of FIG. 3B.
Figure 4B:
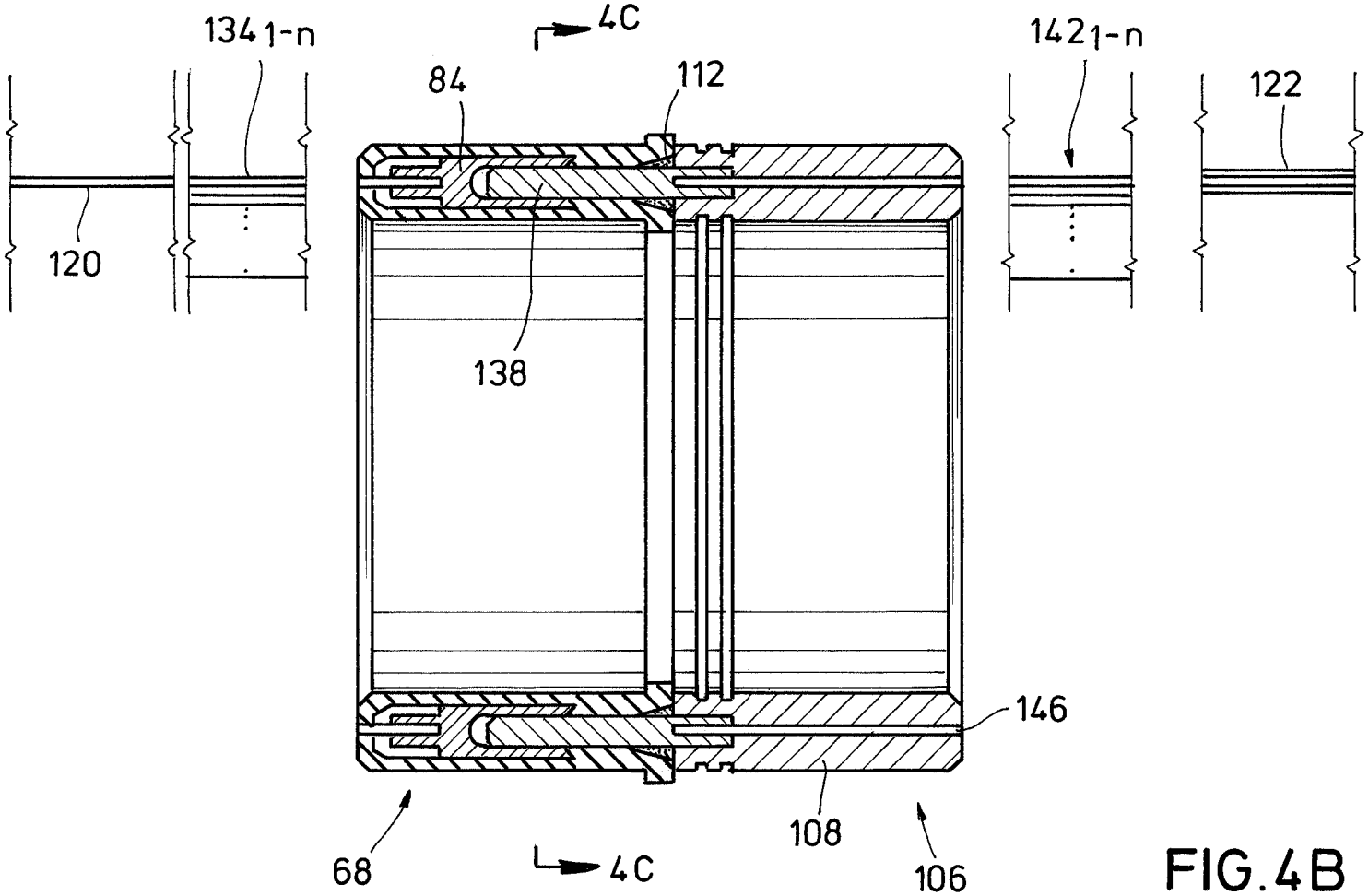
FIG. 4B is a side sectional view of an example of the electrical wet connect of FIG. 3B.

Illustrated in FIGS. 4A and 4B are side sectional views of the socket assembly 68, plug assembly 106, and the electrical wet connect 118. In the example of FIG. 4A, a radius of the annulus 78 increases proximate the downstream end 80. This configuration provides for easier insertion of the conductor elements 114 and insulating elements 116, yet the radius of the annulus 78 spaced axially away from downstream end 80 is sized to apply a tight fit around the conductor elements 114 and insulating tabs 116. Further shown is a side sectional view of the mounting ring 86 illustrating its U shaped cross section, and with its closed end adjacent upstream end 76 of boot 70, an open end of mounting ring 86 faces away from upstream end 76 and receives receptacles 84. Illustrated in FIG. 4B is how the triangular cross section of insulating ring 112 upstream end corresponds to the cross section of annulus 78 proximate downstream end 80 of boot 70. The complementary shapes of the ring 112 and annulus 78 result in a tight seal between one another to prevent fluid from migrating into the annulus 78, and where the conductor elements 114 engage the receptacles 84.

Figures 5A, 5B, 5C:
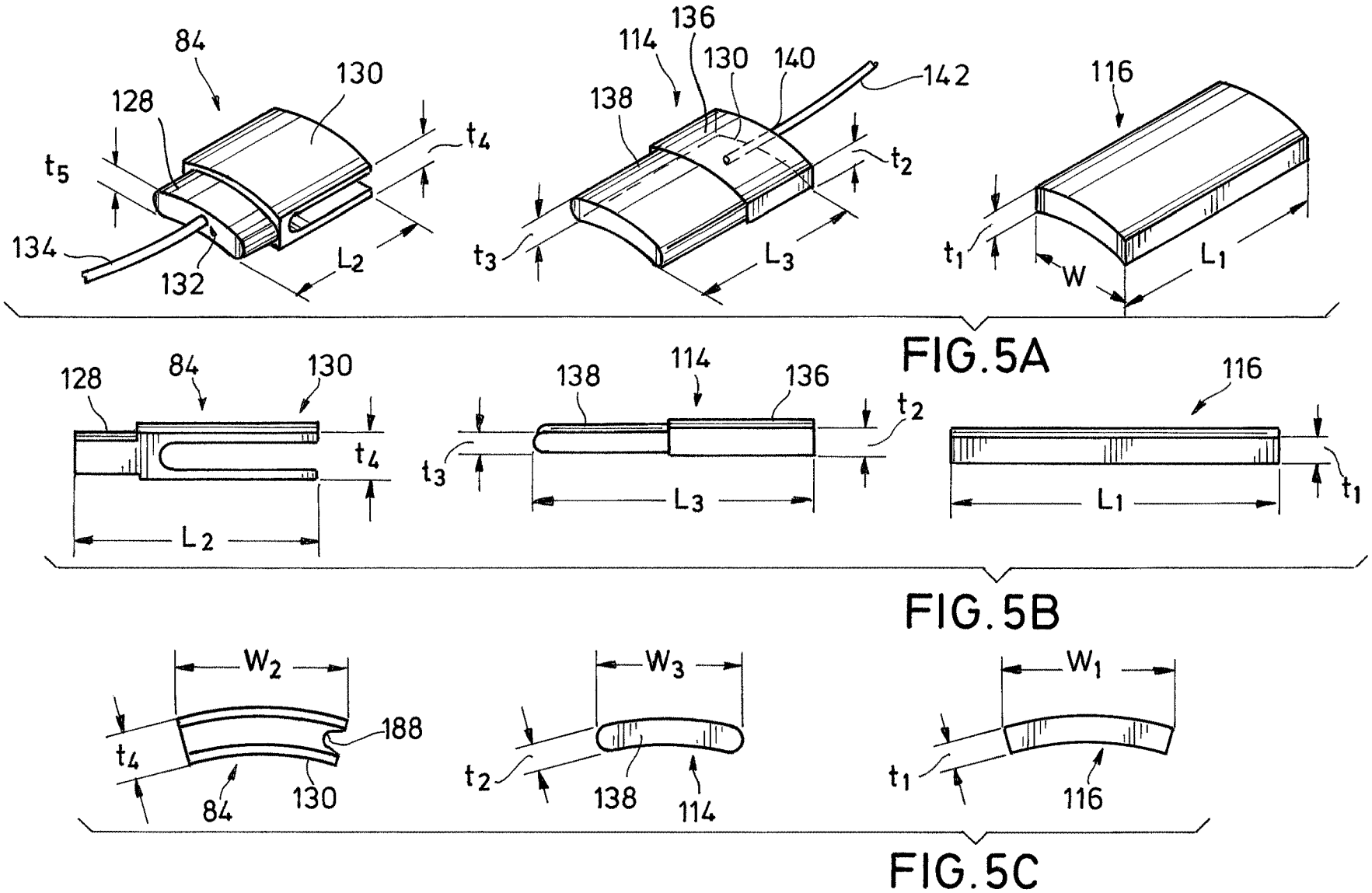
FIG. 5A is a perspective view of examples of a receptacle, a conductor element, and an insulating tab for use in the electrical wet connect of FIG. 3B.
FIG. 5B is a side view of examples of the receptacle, the conductor element, and insulating tab of FIG. 5A.
FIG. 5C is an end view of examples of the receptacle, the conductor element, and insulating tab of FIG. 5A.

Shown in a perspective view in FIG. 5A are examples of the receptacle 84, conductor element 114, and insulating tab 116. In this example, receptacle 84 includes a base 128 shown having an elongate width; base 128 is the portion of receptacle 84 that is set within the mounting ring 86 (FIG. 4A). Projecting axially from the base 128 is a prong section 130, which is laterally intersected by the channel 88. Inner and outer radial surfaces of the base 128 and prong 130 are generally curved, and have a radius similar to that of the mounting ring 86. When installed in the socket assembly 68 (FIG. 2), respective widths of the base 128 and prong 130 extend circumferentially about axis $A_X$. A hole 132 extends axially through the base 128 on a side opposite prong 130, and in which a socket lead 134 is inserted. In an example, socket leads 134 from each of the receptacles 84 are bundled together to form the electrical bus 120 (FIG. 3B). Also shown in FIG. 5A is a perspective view of the conductor element 114 and which includes a base portion 136 shown having an elongate width, and is the portion of each conductor element 114 that mounts in the insulator ring 112 of FIG. 4B. Projecting axially from base portion 136 is an electrically conducting pin 138 which is the portion of the conductor element 114 that inserts into the channel 88. Inner and outer radial surfaces of the base portion 136 and pin 138 are generally curved, and have a radius similar to that of the insulating ring 112. When installed in the plug assembly 106 (FIG. 2), respective widths of the base portion 136 and pin 138 extend circumferentially about axis $A_X$.

Illustrated in FIGS. 5B and 5C are side and end views of the receptacles 84, conductor elements 114, and insulating tabs 116. From these figures it can be shown that the width of the insulating tabs 116 exceeds that of the widths of the receptacle 84 and conductor elements 114. Moreover, a thickness $t_1$ of insulating tab 116 exceeds thicknesses $t_2$ of the base 136 and $t_3$ of the pin 138. Thickness $t_1$ also exceeds a thickness $t_4$ of the prong 130 and of the base 132. Further shown in FIG. 5C is how the inner and outer radial surfaces of the receptacle, conductor element 114, and insulating tab 116 are generally curved.

An example of the electrical wet connect 118 is shown in an axial view in FIG. 4C, and which is taken along lines 4C-4C of FIG. 4B. Illustrated in FIG. 4C is an example of the insulating tabs 116 filling the spaces 126 between the receptacles 84. As pointed out above, the advantage of strategically placing the insulating tabs 116 provides a connection between the conducting pins 114 and receptacles 84 that will not be compromised or shorted by electrical connection through fluid that may be caught in the area. Referring back to the example of FIG. 4A, socket leads $\mathbf{134}_{1\text{-}n}$ are shown that each connect to one of the receptacles 84, and are bundled together to form the electrical bus 120. Similarly, pin leads $\mathbf{142}_{1\text{-}n}$ are shown, that each have an end connected to one of the conductor elements 114, are similarly bundled together to form the electrical bus 122. Further provided in the example of FIG. 4A are holes 140 shown formed axially in the insulator ring 112 and in which the pin leads 142 are inserted. Apertures 144 are provided within the boot 70 that extend axially from the upstream end 76 and intersect with hole 132. Further provided in FIG. 4A are examples of passages 146 shown extending axially through a sidewall of body 108 and that intersect holes 140, which provides a path for pin leads 142 to insert into hole 140. In one example, while forming the electrical wet connect 118 the socket and plug assemblies 68, 106 are azimuthally positioned in a particular orientation so that each of the conductor elements 114 (or receptacles 84) register with designated receptacles 84 (or conductor elements 114). Further in this example, the particular orientation of the elements 114 or receptacles 84 puts specific socket leads $\mathbf{134}_{1\text{-}n}$ into signal communication with specific pin leads $\mathbf{142}_{1\text{-}n}$ so that a signal traveling along the string 10 (FIG. 1) is transmitted to a designated destination in the string 10. Moreover, orienting the socket and plug assemblies 68, 106 is not limited to the embodiments discussed herein, but includes any now known or later developed manner of orienting.

Figure 6:
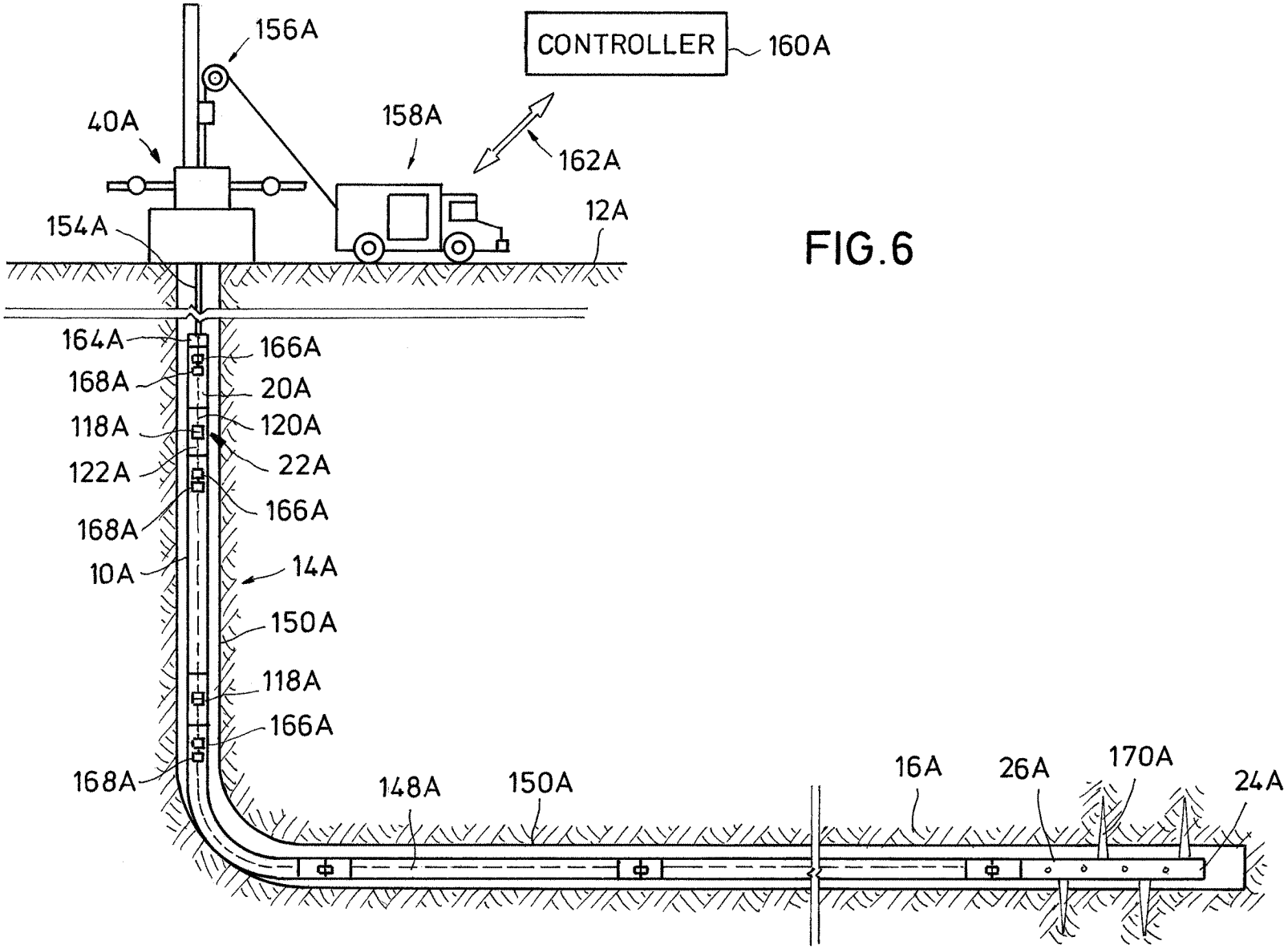
FIG. 6 is a side partial sectional view of the tool string being assembled in FIG. 1 deployed in a wellbore.

Shown in a side partial sectional view in FIG. 6, is one example of operating a downhole string 10A that is made up of a number of downhole tools 20A and connected with connector assemblies 22A. Included in each connector assembly 22A is an electrical wet connect 118A with its corresponding busses 120A, 122A extending to adjacent tools 20A. A communication bus 148A is shown in a dashed outline, and which schematically represents the combination of the wet connects 118A, busses 120A, 122A, and busses within the tools (not shown) that form signal communication along the entire string 10A. In an embodiment, signal communication along the entire string 10A means that signals are sent to every tool 20A in the string 10A, received by every tool 20A in the string 10A, that every tool in the string 20A transmits signals, and where the signals are transmitted along the string 10A via the electrical wet connects 118A. For the purposes of discussion herein, a signal includes anything electromagnetic, such as electricity, light, radio waves, an electromagnetic field, and combinations. In an example, the signal provides energy to a load (such as a motor or actuator), represents data, senses a condition/property, and combinations thereof.

As illustrated in FIG. 6, wellbore 14A includes a vertical section 150A and which connects to a horizontal section 152A on its lower end. In this example, the string 10A is deployed within wellbore 14A on coiled tubing 154A. The coiled tubing 154A is urged within the wellbore 14A by an injector head 156A shown mounted on the wellhead assembly 40A. The coiled tubing 154A is schematically illustrated as coming from within a service truck 158A on surface 12A, downhole string 10A is optionally controlled and operated from within truck 158A, such as by operations personnel in truck 158A. In an alternative, a controller 160A is provided, which can be within or outside of truck 160A, and which is in communication with tools 20A of downhole string 10A. In one example controller 160A includes an information handling system (IHS). In one example, controller 160A automatically transmits signals for use in controlling string 10A. In an alternative, the IHS stores recorded data and/or processes the data into a readable format. Embodiments exist with the IHS at the surface 12A, in the wellbore 14A, or partially above and below the surface. The IHS optionally includes a processor, memory accessible by the processor, nonvolatile storage area accessible by the processor, and logics for performing each of the steps above described. Further optionally, a communications module 164A, similar to a cablehead, is provided on an upper end of the string 10A and which provides communication between the string 10A and surface 12A, such as service truck 158A and/or controller 160A. In an alternative, receivers 166A and transmitters 168A are provided on the tools 20A, and which selectively communicate with other receivers 166A or transmitters 168A on other tools 20A, or with surface 12A. Examples exist where the receivers 166A and transmitters 168A communicate with the communication bus 148A via hardwired connections or wireless telemetry.

In a non-limiting example of operation, one of the downhole tools 20A is a perforating gun 24A with shape charges 26A and where a command signal from on surface, such as from controller 160A is delivered through the downhole string 10A to detonate the shape charges 26A that in turn form perforations 170A that intersect formation 16A.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A connector assembly for use in a downhole tool string comprising:

an axis;

an annular male sub having an upstream end profiled for attachment to a first downhole tool, a downstream end, and a protrusion on an outer surface;

an annular female sub having an upstream end adapted for insertion of the downstream end of the male sub, a downstream end profiled for attachment to a second downhole tool, and a sidewall having an aperture that receives the protrusion when the male sub is inserted into the upstream end;

a socket assembly in the male sub that comprises, receptacles arranged along a path that circumscribes the axis, and signal leads that are connected to each of the receptacles; and a plug assembly in the female sub that comprises, conductor elements that each engage a one of the receptacles when the annular male sub and the annular female sub are latched to one another, insulating tabs disposed between adjacent ones of the conductor elements that occupy spaces between adjacent receptacles when the conductor elements engage the receptacles and define electrically insulating barriers in the spaces, and signal leads that are connected to each of the conductor elements, and that are in respective communication with the signal leads connected to the receptacles;

wherein the socket and plug assemblies comprise an electrical wet connect when the conductor elements engage the receptacles; and wherein the signal leads connected to the receptacles are in signal communication with the first downhole tool, and the signal leads connected to the conductor elements are in signal communication with the second downhole tool, and the first and second downhole tools are in signal communication via the electrical wet connection.

2. The connector assembly of claim 1, wherein the signal leads on the socket assembly are combined into a socket assembly electrical bus, and wherein the signal leads on the plug assembly are combined into a plug assembly electrical bus.

3. The conductor assembly of claim 1, wherein the receptacles have inner and outer radial surfaces that are curved along a path that circumscribes the axis.

4. The connector assembly of claim 1, wherein the receptacles each have a channel that extends between lateral surfaces of the receptacles and along a path that circumscribes the axis, and wherein pins on the ends of the conductor elements axially insert into the receptacles.

5. The connector assembly of claim 1, wherein the conductor elements have ends that anchor into an insulator ring that circumscribes the axis, and wherein the conductor elements project axially away from insulator ring.

6. The connector assembly of claim 1, wherein the socket assembly comprises an annular boot having inner and outer sidewalls that extend longitudinally along the axis and that are disposed radially away from one another to form an annulus, and wherein the receptacles are in the annulus.

7. The connector assembly of claim 6, wherein ends of the receptacles opposite from their engagement with the conductor elements are set in a mounting ring in the annulus.

8. The connector assembly of claim 1, wherein the signal leads in the plug assembly are electrically isolated from one another, and wherein the signal leads in the socket assembly are electrically isolated from one another.

9. A connector assembly for use in a downhole tool string comprising:

an axis;

first and second subs that selectively latch to one another on proximate ends, and each have distal ends that are profiled for respective attachment to first and second downhole tools;

a socket assembly in the first sub that comprises, receptacles arranged along a path that circumscribes the axis, and signal leads that are connected to each of the receptacles; and a plug assembly in the second sub that comprises, conductor elements that each engage a one of the receptacles when the first and second subs are latched to one another, insulating tabs disposed between adjacent ones of the conductor elements that occupy spaces between adjacent receptacles when the conductor elements engage the receptacles and define electrically insulating barriers in the spaces, and signal leads that are connected to each of the conductor elements, and that are in respective communication with the signal leads connected to the receptacles;

wherein the signal leads on the socket assembly are combined into a socket assembly electrical bus, and wherein the signal leads on the plug assembly are combined into a plug assembly electrical bus.

10. The connector assembly of claim 9, wherein channels are formed in ends of the receptacles facing the conductor elements and that are at substantially the same radial location as ends of the conductor elements facing the receptacles, so that when the socket and plug assemblies are urged together, the ends of the conductor elements insert into the channels.

11. The connector assembly of claim 9, wherein the socket assembly comprises a boot with an annular space in which the receptacles are disposed, and wherein the conductor elements and insulating tabs insert into the annular space when the conductor elements engage the receptacles.

12. The connector assembly of claim 9, further comprising an axial bore that is circumscribed by the socket and plug assemblies, and wherein the first and second downhole tools are in communication with one another through the axial bore.

13. The connector assembly of claim 9, wherein the socket and plug assemblies comprise an electrical wet connect when the conductor elements engage the receptacles; and wherein the signal leads connected to the receptacles are in signal communication with the first sub, and the signal leads connected to the conductor elements are in signal communication with the second sub, and the first and second subs are in signal communication via the electrical wet connection.

14. A downhole string comprising:

a first downhole tool;

a second downhole tool;

and a connector assembly comprising:

first and second subs latched to one another on proximate ends, and attached to the first and second downhole tools on respective distal ends;

receptacles in the first sub that are arranged along a path that circumscribes the axis;

first signal leads that are connected to each of the receptacles;

conductor elements in the second sub that each engage a one of the receptacles when the first and second subs are latched to one another;

insulating tabs disposed between adjacent ones of the conductor elements that occupy spaces between adjacent receptacles when the conductor elements engage the receptacles and define electrically insulating barriers in the spaces;

and second signal leads that are connected to each of the conductor elements, and that are in respective communication with the first signal leads connected to the receptacles;

wherein the first signal leads are combined into a plug assembly electrical bus and the second signal leads are combined into a socket assembly electrical bus.

15. The downhole string of claim 14, wherein the first and second downhole tools comprise perforating guns.

16. The downhole string of claim 14, further comprising a controller that is in electrical communication with the downhole tools via connections between the receptacles and conductor elements.

* * * * *